US009259744B2

(12) United States Patent
Hansen

(10) Patent No.: US 9,259,744 B2
(45) Date of Patent: Feb. 16, 2016

(54) FAUCET

(75) Inventor: David E. Hansen, Howards Grove, WI (US)

(73) Assignee: KOHLER CO., Kohler, WI (US)

( * ) Notice: Subject to any disclaimer, the term of this patent is extended or adjusted under 35 U.S.C. 154(b) by 899 days.

(21) Appl. No.: 13/451,262

(22) Filed: Apr. 19, 2012

(65) Prior Publication Data

US 2012/0267455 A1 Oct. 25, 2012

Related U.S. Application Data

(60) Provisional application No. 61/478,384, filed on Apr. 22, 2011.

(51) Int. Cl.

| | |
|---|---|
| ***E03C 1/04*** | (2006.01) |
| ***B05B 1/18*** | (2006.01) |
| ***B05B 15/06*** | (2006.01) |
| *B05B 1/16* | (2006.01) |

(52) U.S. Cl.

CPC ..... *B05B 1/18* (2013.01); *B05B 15/067* (2013.01); *B05B 15/068* (2013.01); *B05B 1/16* (2013.01); *E03C 2001/0415* (2013.01)

(58) Field of Classification Search

CPC ..... E03C 1/0404; E03C 1/0417; E03C 2001/0416; F16L 39/00

USPC ..... 4/675–678; 137/801; 239/525, 588

See application file for complete search history.

(56) References Cited

U.S. PATENT DOCUMENTS

| | | | | |
|---|---|---|---|---|
| 4,349,940 | A | 9/1982 | Fleischmann et al. | |
| 4,515,037 | A | 5/1985 | Block | |
| 4,961,443 | A | 10/1990 | Buccicone et al. | |
| 6,220,278 | B1 | 4/2001 | Sauter et al. | |
| 6,666,227 | B2 | 12/2003 | Erickson | |
| 6,757,921 | B2 | 7/2004 | Esche | |
| 6,877,172 | B2 * | 4/2005 | Malek et al. | 4/678 |
| 7,627,909 | B2 | 12/2009 | Esche | |
| 7,934,520 | B2 | 5/2011 | Esche et al. | |
| 8,056,574 | B2 | 11/2011 | Erickson et al. | |
| 8,061,386 | B2 | 11/2011 | Mueller et al. | |
| 8,070,076 | B2 | 12/2011 | Erickson et al. | |
| 8,186,375 | B2 | 5/2012 | Andersen et al. | |
| 2008/0067264 | A1 | 3/2008 | Erickson et al. | |

* cited by examiner

*Primary Examiner* — Tuan N Nguyen

(74) *Attorney, Agent, or Firm* — Foley & Lardner LLP

(57) ABSTRACT

A pull-out faucet is provided. The faucet includes a spout having an outlet end, a spray head having an engaging end, and a sleeve disposed between the outlet end of the spout and the engaging end of the spray head and configured to detachably couple the spray head to the spout. The sleeve comprises a substantially rigid first portion and a substantially compliant second portion.

18 Claims, 4 Drawing Sheets

FAUCET

CROSS-REFERENCE TO RELATED PATENT APPLICATIONS

This application claims priority to U.S. Provisional Application 61/478,384, titled "Faucet" and filed Apr. 22, 2011, the entirety of which is incorporated herein by reference.

BACKGROUND

The present application relates generally to the field of faucets. More specifically, the present application relates to faucets having a detachable spray head and the coupling mechanism used to detachably couple between a spray head to a faucet, such as the spout of the faucet.

Faucets having a detachable spray head generally include a coupling between the spray head and a spout of the faucet to provide for the detachable coupling of the spray head and to allow an increased range of the spray head. Such couplings are often formed of several components, which may increase the cost (e.g., part, labor, etc.) and require mechanical assistance to install or assemble the coupling to the faucet. Additionally, such couplings have a tendency for the several components to become misaligned, such as during installation. Such misalignment may deform the mating parts creating an interference with the spray assembly, which can lead to an undesirable increase in the effort (or force) that is required to decouple the spray assembly from the faucet. Additionally, such couplings have a larger variation in tolerances, which can lead to an undesirably loose coupling between the spray assembly and the spout causing the spray assembly to droop or wobble from the spout. Some configurations of faucets that include such couplings are viewed as bulky and visually unappealing, while others include locking devices, such as ones that require the user to twist or rotate the spray assembly to lock into position. Also, when such locking devices break or fail, the spray assembly is unable to be coupled to the faucet.

The faucets disclosed herein are advantageously configured with a coupling that allows for detachable coupling of the spray head from the faucet while addressing one or more of the issues discussed above.

SUMMARY

One embodiment relates to a pull-out faucet. The faucet includes a spout having an outlet end, a spray head having an engaging end, and a sleeve disposed between the outlet end of the spout and the engaging end of the spray head and configured to detachably couple the spray head to the spout. The sleeve comprises a substantially rigid first portion and a substantially compliant second portion.

Another embodiment relates to a pull-out faucet. The faucet includes a sleeve having a rigid first portion and a compliant second portion, the second portion comprising a circumferential member extending around at least a portion of a circumference of the sleeve. The faucet further includes a spout coupled to the sleeve, the spout having a recess formed in a surface thereof, the recess configured to receive the circumferential member of the sleeve. The faucet further includes a spray head having an engaging end configured to releasably couple to the sleeve.

Another embodiment relates to a coupling sleeve for a pull-out faucet, the faucet including a spray head having an engaging end, the faucet further including a spout having an outlet end configured to receive the coupling sleeve and having an inner surface defining a recess. The coupling sleeve includes an inner surface, an outer surface, a substantially rigid first portion, and a compliant second portion integrally formed on the first portion. The second portion includes a circumferential member extending along the outer surface and configured to engage the recess of the spout and includes a plurality of longitudinal members extending along the inner surface and configured to stabilize the spray head within the coupling sleeve.

The foregoing is a summary and thus by necessity contains simplifications, generalizations and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
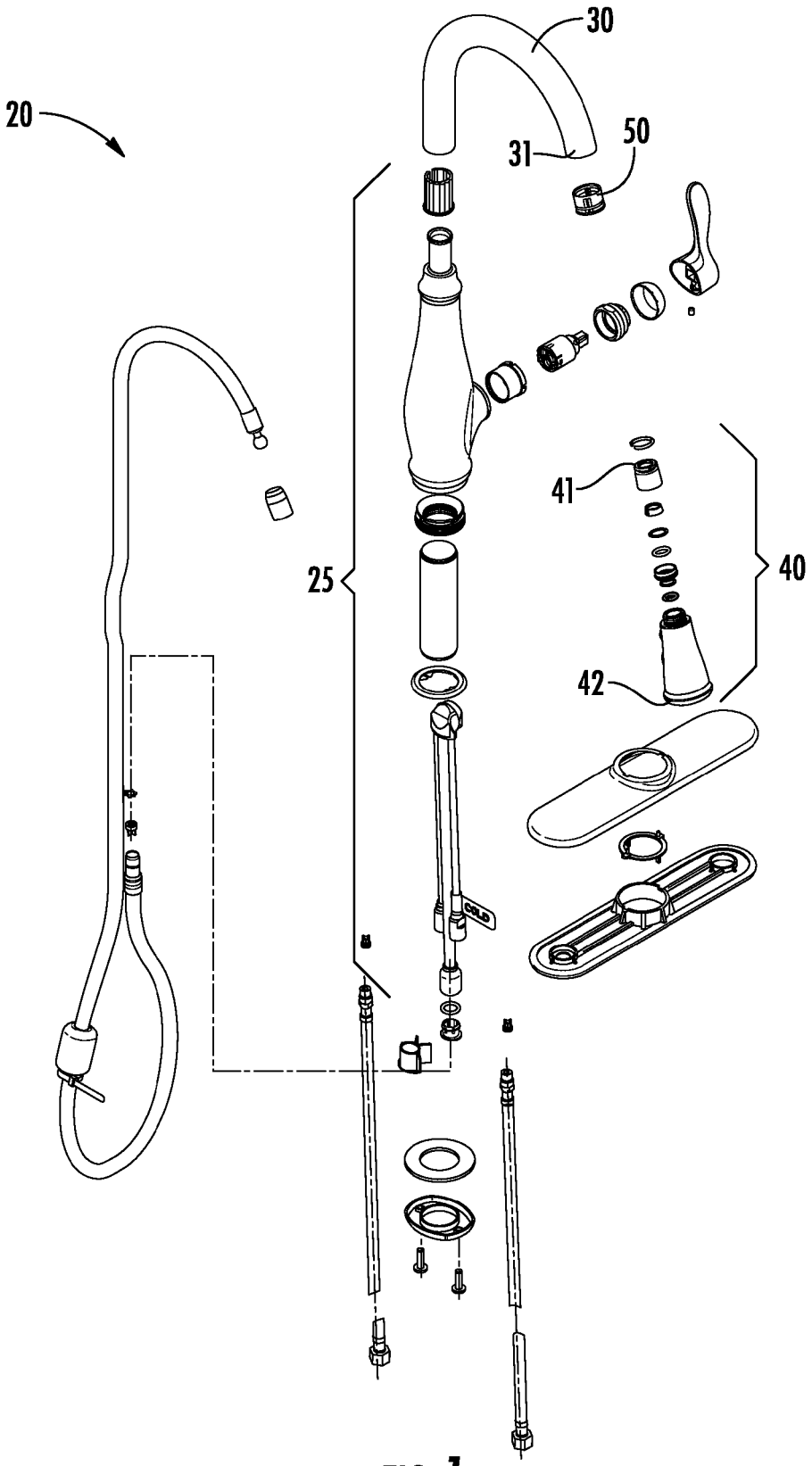
FIG. 1 is an exploded perspective view of an exemplary embodiment of a faucet illustrating the spray head and sleeve removed from the spout.

FIG. 1 illustrates an exemplary embodiment of a faucet 20 configured to selectively discharge water that is transferred from a water supply or source. The faucet 20 includes a spout 30 that extends from a body (or base) 25, a spray head 40 for providing the selective discharge of water, and a coupler, shown as a sleeve 50, provided between the spout 30 and the spray head 40 to provide for detachable coupling of the spray head 40 from the spout 30.

The body 25 may be configured to be coupled to the water supply through a connection to receive the flow of water and may be configured to selectively transfer the flow of water received to the spout 30. For example, the body 25 may include a first connection for coupling to the cold water supply and a second connection for coupling to the hot water supply. The body 25 may mount (or connect) to another device, such as a sink (not shown) or countertop (not shown), to support the body. The body 25 may include a valve assembly configured to selectively transfer the water (e.g., hot water and cold water) received from the water supply through the spout 30. The volumetric flow of water through the valve assembly may be controlled by a valve opening, which may be controlled by a handle or lever. The faucet 20 and/or body 25 may include more than one handle. For example the faucet 20 may include a first handle to control the volumetric flow of water and a second handle to control the temperature of water (i.e., to control the ratio or mixture of hot and cold water). As another example, the faucet 20 may include a first handle to control the volumetric flow of hot water and a second handle to control the volumetric flow of cold water. It should be noted that the body may be configured according to other embodiments, and those disclosed herein are not meant as limitations.

The spout 30 may configured as an elongated and curved hollow tube, wherein through the hollow center water is carried from the body 25 to the spray head 40. The spout 30 may include a first (or inlet) end that is configured to receive the flow of water from the body 25 and a second (or outlet) end 31 to transfer the flow of water to the spray head 40. According to an exemplary embodiment, the spout 30 may be integrally formed with the body 25. According to another exemplary embodiment, the spout 30 may be formed separately from the body 25, wherein the first end of the spout 30 may be coupled to the body to form one functional member. It should be noted that the shape and size (e.g., diameter, length, etc.) of the spout 30 may be tailored to provide varying functional configurations or to tailor the aesthetics of the faucet 20, and those embodiments disclosed herein are not meant as limitations.

The spray head 40 is configured to discharge the flow of water received from the spout 30 onto the directed target from the outlet (or exit) end 42. The outlet end 42 of the spray head 40 may include a centrally provided aerator cartridge having one or a plurality of nozzles or orifices to discharge the flow of water as a stream or an aerated column from the outlet end 42. The outlet end 42 may also include an outlet ring, such as provided around the aerator cartridge, having a plurality of nozzles or orifices to discharge the flow of water as a shower-like spray pattern. The spray head 40 may include one or more than one button for controlling the flow of water from the outlet end 42. For example, the spray head 40 may include a button configured to switch the flow of water between the aerator cartridge and the outer ring, such as to switch the water flow between an aerated column and a shower-like spray. Also, for example, the spray head 40 may include a second button configured to selectively interrupt the flow of water exiting the outlet end 42, wherein the flow of water may be stopped and restarted by activation of the second button. The spray head 40 also includes an engaging end 41 that is configured to be detachably coupled to the spray head 40 to the outlet end 31 of the spout 30. It should be noted that the spray head may be configured according to other embodiments, and those disclosed herein are not meant as limitations.

Figure 2:
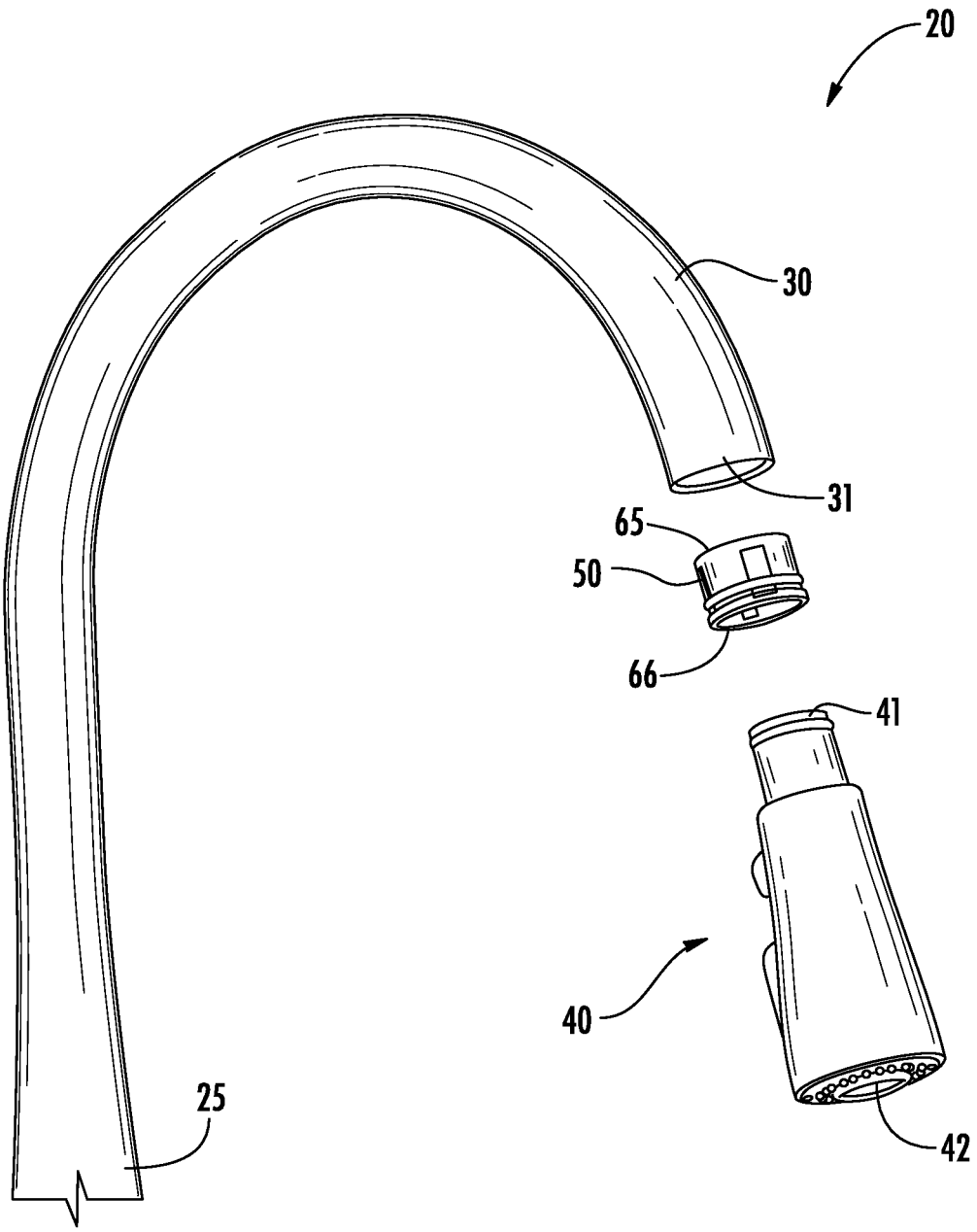
FIG. 2 is a perspective view of a portion of the faucet of FIG. 1, illustrating the spray head and sleeve exploded from the spout.

To facilitate the detachable coupling of the spray head 40 to the spout 30, the faucet 20 includes the sleeve 50. FIG. 2 illustrates an exemplary embodiment of the sleeve 50. According to an exemplary embodiment, the sleeve 50 is provided between the engaging end 41 of the spray head 40 and the outlet end 31 of the spout 30 to provide detachable coupling between the spout 30 and the spray head 40 of the faucet 20. The sleeve 50 allows the spout 30 to retain and support the spray head 40 when the spray head 40 is (detachably) coupled to the spout 30, such that outlet end 31 of the spout 30 and the engaging end 41 of the spray head 40 remain substantially concentric (or aligned) and adjacent. The sleeve 50 also allows the user to decouple (detach) the engaging end 41 of the spray head 40 from the outlet end 31 of the spout 30, such that the flow of water may be directed on a target that is not aligned with the outlet end 31 of the spout 30. For example, the faucet 20 may include a hose (or flexible tube) for carrying the flow of water, wherein the hose may connect at one end to the outlet end 31 of the spout 30 and may connect at the other end to the engaging end 41 of the spray head 40.

According to an exemplary embodiment, the sleeve 50 is a tubular member having a substantially circular cross sectional shape. The sleeve 50 defines a longitudinal axis as the sleeve 50 extends between a first end 65 that is configured to mate with or be inserted into the spout 30 and a second end 66 that is configured to mate with or be received by the spray head 40. According to the embodiment illustrated in FIG. 2, the first end 65 of the sleeve 50 may be inserted into the outlet end 31 of the spout 30, wherein once in position, the sleeve 50 is coupled to the spout 30. The sleeve 50 may include a member (e.g., circumferential member) that is retained by the spout in order for the sleeve 50 to remain coupled to the spout 30. Also, the engaging end 41 of the spray head 40 may be inserted into the second end 66 of the sleeve 50, wherein once in position the spray head 40 is coupled to the sleeve 50. The engaging end 41 of the spray head 40 may include a detent 45 (shown in FIG. 5) that is retained by the first end 65 of the sleeve 50, such that the sleeve 50 is configured to remain coupled to the spout 30 when the spray head 40 is selectively detached or decoupled from the spout 30. However, the sleeve 50 may be configured to remain coupled to the spray head 40 when the spray head 40 is selectively detached or decoupled from the spout 30.

Figure 3:
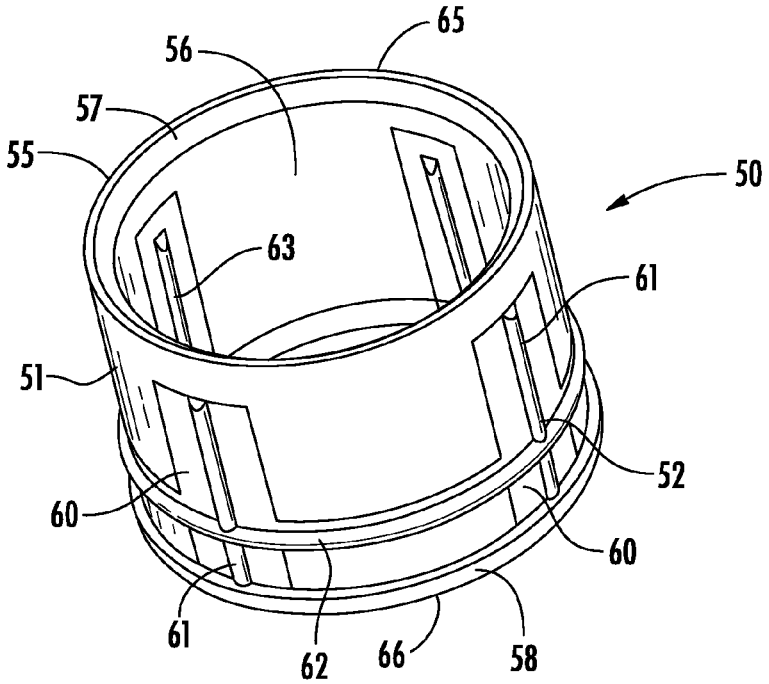
FIG. 3 is a perspective view of an exemplary embodiment of a sleeve for use in a faucet, such as the faucet of FIG. 1.
Figure 4C:
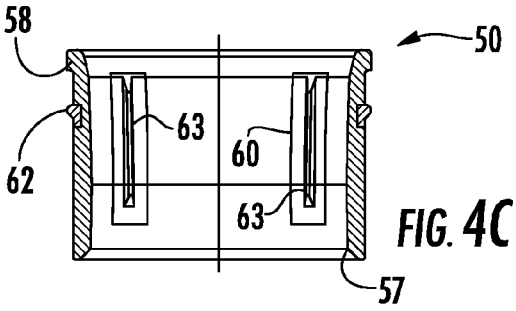
FIG. 4C is a cross-sectional view of the sleeve of FIG. 4A taken along the line 4C-4C in FIG. 4A.
Figure 4A:
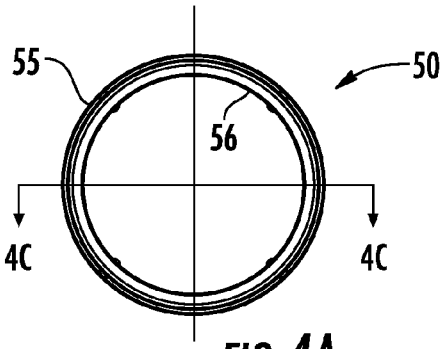
FIG. 4A is a top view of the sleeve of FIG. 3.
Figure 4B:
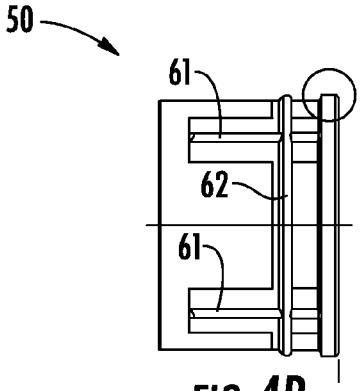
FIG. 4B is a side view of the sleeve of FIG. 4A.

As shown in FIG. 3, and according to an exemplary embodiment, the sleeve 50 includes a first portion 51 made from a first material that is integrally formed, such as through a co-molding (or overmolding) process, with a second portion 52 made from a second material. The first portion may be molded (e.g., injection molded) in a first die using the first material, wherein the first die includes tooling to form cavities in the first portion. The molded first portion may be transferred by an automated or manual process to the second die wherein the cavities formed in the first portion are filled using a second material. The first material comprising the first portion 51 is configured to provide structural rigidity and durability to the sleeve 50, and may be made from a polymer, a reinforced polymer (e.g., glass-filled polypropylene), or any suitable material. The second material comprising the second portion 52 is configured to be flexible or compliant to absorb tolerances and to provide for selective retention between the sleeve 50 and the spout 30 and/or the spray head 40. The second material comprising the second portion 52 may be an elastomer, a thermoplastic elastomer (e.g., santoprene), or any suitable material.

According to an exemplary embodiment, the first portion 51 includes an outer surface 55, which may be defined by an outer diameter, and an inner surface 56, which may be defined by an inner diameter. The outer and inner surfaces 55, 56 may extend between the first and second ends 65, 66 forming a substantially cylindrically shaped first portion 51. The outer surface 55 of the first portion 51 is configured to be received within the spout 30 when the sleeve 50 is coupled to the outlet end 31 of the spout 30, for example, by being provided adjacent to an inner surface of the hollow wall of the spout 30 when the sleeve 50 is coupled to the outlet end 31 of the spout 30. The inner surface 56 is configured to receive the engaging end 41 of the spray head 40 when the sleeve 50 is coupled to the spray head 40, for example, by being provided adjacent to the engaging end 41 of the spray head 40 when the sleeve 50 is coupled to the spray head 40.

The first end 65 of the sleeve 50, which may be proximate to the spout 30, may also include a first retaining feature 57 that is configured to retain the spray head 40 to the sleeve 50 when the spray head 40 is to be supported at the spout 30. According to an exemplary embodiment, the first retaining feature 57 is configured as a chamfer or inclined surface that extends between the outer surface 55 and the inner surface 56. The first retaining feature 57 is configured to be engaged by a corresponding or second retaining feature, shown as a detent 45, that extends from the engaging end 41 of the spray head 40. The first retaining feature 57 may be configured having a curved surface, irregular shaped surface, or any shaped surface that provides for retention of the engaging or abutting portion of the spray head 40. The first retaining feature 57 may extend the entire periphery (or profile or circumference) of the sleeve 50 or may extend less than the entire periphery of the sleeve 50, for example, by being provided intermittently about the periphery of the sleeve 50.

The second end 66 of the sleeve 50, which may be proximate to the spray head 40, may include a lip 58 to control the coupled position of the sleeve 50 relative to the spout 30, such as by limiting the length of the sleeve 50 that can be inserted into the spout 30. In other words, the lip 58 may be configured to determine how far the sleeve 50 can be inserted into the outlet end 31 of the spout 30. For example, the lip 58 may prohibit the sleeve 50 from being inserted farther into the spout 30 by having a diameter that is larger than the diameter of the opening in the outlet end 31 of the spout 30. The lip 58 may be a shoulder that extends beyond the outer surface 55 of the first portion 51. The outlet end 31 of the spout 30 may include a ledge 46 that is formed by a bore or undercut that reduces the wall thickness of the spout 30 in the region of the ledge 46, wherein the ledge 46 may be configured to receive the lip 58 of the sleeve 50 to thereby control the position of the sleeve 50 relative to the end of the spout 30 when the sleeve is coupled to the spout. This configuration provides a repeatable coupled position (or length of engagement) between the sleeve 50 and the spout 30.

The second portion 52 of the sleeve 50 may include one or more longitudinal members 61, 63, which may be spaced apart by similar angular offsets or by varying angular offsets. According to an exemplary embodiment, the second portion 52 of the sleeve 50 includes four outer longitudinal members 61, with each adjacent pair of outer longitudinal members offset by a substantially similar angular offset of ninety degrees (90°). The outer longitudinal members 61 may extend a radial length away from the outer surface 55 away from the center of the sleeve 50 to provide stability between the sleeve 50 and the spout 30 by absorbing tolerances between the sleeve 50 and the spout 30. The inner longitudinal members 63 may extend a radial length away from the inner surface 56 toward the center of the sleeve 50, which may be aligned with or differ from the radial lengths along the outer diameter, to provide stability between the sleeve 50 and the spray head 40 by absorbing tolerances between the sleeve 50 and the spray head 40. The longitudinal members may be configured to have a semi-circular, polygonal, or any suitable shape (e.g., cross-sectional shape) and may extend a height away from the outer diameter of the sleeve 50. The height may be tailored, for example, based on the tolerances to be absorbed between the sleeve 50 and the spout 30 and/or desired force required to decouple the sleeve 50 from the spout 30. Also, the number of longitudinal members may be varied to influence (e.g., increase or decrease) the force required to decouple the sleeve from the spout.

According to an exemplary embodiment, the second portion 52 of the sleeve 50 also includes a circumferential member 62 that extends away from the outer surface 55 (and away from the center of the sleeve 50) along the entire circumference of the sleeve 50. According to other embodiments, the second portion 52 includes a plurality of circumferential members 62, which may be spaced apart by similar or varying offset distances. The circumferential member 62 is configured to influence the retention of the sleeve 50 by the spout 30, such as by influencing the force required to separate the sleeve 50 from the spout 30 after being detachably coupled together. The circumferential members 62 may be configured to extend along the entire circumference of the sleeve 50 or a portion less than the entire circumference of the sleeve. The height, width, and shape (e.g., cross-sectional) of the circumferential member 62 may vary or may be tailored to different faucet designs. For example, the height of the circumferential member 62 may be tailored to influence the force required to separate the sleeve 50 from the spout 30.

The second portion 52 of the sleeve 50 may also include a base 60 aligned with each longitudinal member 61, 63 and/or circumferential member 62. The base 60 may reduce or eliminate the flash that may form during the co-molding or overmolding process of the second material onto the first portion 51 made from the first material. According to an exemplary embodiment, the first portion 51 of the sleeve 50 is formed to include a plurality of cavities, wherein the plurality of cavities are filled with the second material to form the second portion 52 of the sleeve 50 during the second process (e.g., co-molding or overmolding). The cavities formed during the first process of forming the first portion 51 may extend through the full thickness of the wall between the outer and inner diameters, or may extend inward from the outer diameter a distance less than the full wall thickness and/or inward from the inner diameter a distance less than the full wall thickness. The base 60 may be formed to be flush with the outer and/or inner surfaces 55, 56 and may extend a length and/or radial width that is tailored to minimize the flash that may form during the co-molding process.

Figure 5:
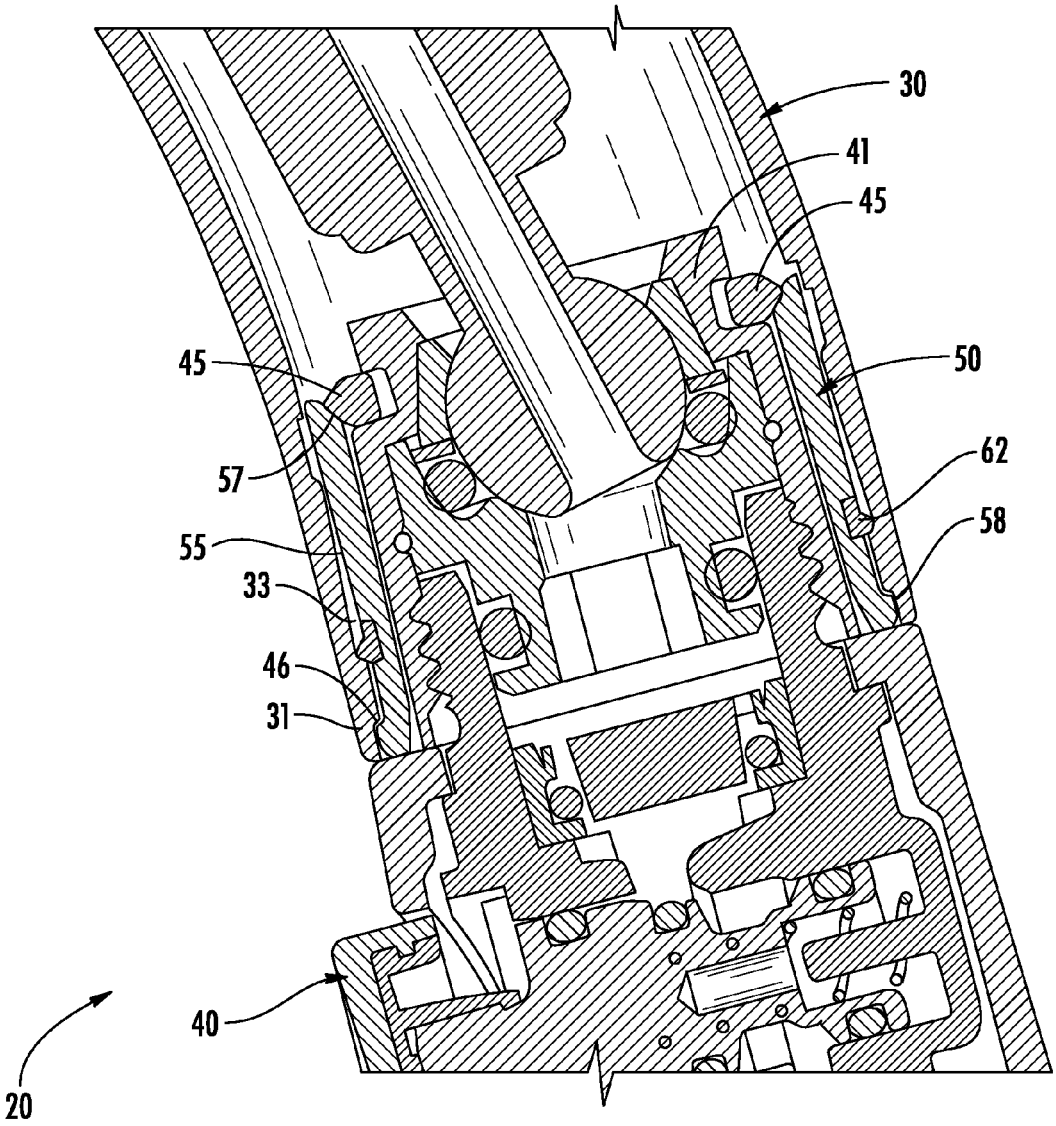
FIG. 5 is a cross-sectional view taken approximately at the mid-width of the faucet of FIG. 1, illustrating the sleeve provided between the coupled spout and spray head.

FIG. 5 illustrates a cross-sectional view taken approximately along the mid-width of the faucet through where the spray head 40 is detachably coupled to the spout 30 through the sleeve 50. According to an exemplary embodiment, there is clearance between the outer surface 55 of the sleeve 50 and the inner surface of the wall of the spout 30 to allow the sleeve 50 to be inserted into the outlet end 31 of the spout 30. The second material comprising the second portion 52, being configured to be flexible or compliant, allows for there to be an interference fit configured between the inner surface of the wall of the spout 30 and the second portion 52, which provides for retention of the sleeve 50 by the spout 30 when coupled together. Upon insertion of the sleeve 50 into the outlet end 31 of the spout 30, the inner surface of the wall of the spout 30 compresses the second portion 52 (e.g., circumferential member 62, longitudinal member 61) of the sleeve 50 creating forces between the sleeve 50 and the spout 30 which function to both stabilize and retain the sleeve 50 in the spout 30.

According to an exemplary embodiment, the outlet end 31 of the spout 30 includes a recess (e.g., an undercut portion, etc.), shown as groove 33, that is configured to receive the circumferential member 62 of the second portion 52 of the sleeve 50 when the sleeve 50 is coupled to the spout 30. The groove 33 extends around the circumference of the inner surface of the wall of the spout 30 and is provided in a location (i.e., a distance offset from the edge of the outlet end 31) to influence the length of the engagement of the sleeve 50 into the spout 30. The groove 33 may extend along the full circumference of the inner surface or may extend a length less than the full circumference, which may correspond to the length and/or position of the circumferential member 62. The depth of the groove 33 cut into the wall of the spout 30 may be tailored based on the height of the circumferential member 62. For example, a deeper groove 33 may be configured to receive a taller circumferential member 62 to provide more engagement between the sleeve 50 and the spout 30, which may require a higher separation force to decouple the sleeve 50 from the spout 30.

The outer longitudinal members 61 (i.e., those extending away from the outer diameter) of the sleeve 50 are configured to have an interference fit with the inner surface of the spout 30. When the sleeve 50 is coupled to the spout 30, the compliant longitudinal members 61 are compressed by the rigid inner surface of the spout 30 inducing forces between the sleeve 50 and the spout 30. These forces help the spout 30 retain the sleeve 50 as well as help align the sleeve 50 and spout 30, such as concentrically. Thus, the compliant outer longitudinal members 61 ensure a proper (e.g., tight) fit between the sleeve 50 and the spout 30 once the sleeve 50 is positioned so that the circumferential member 62 of the sleeve 50 engages the groove 33 of the spout 30.

According to an exemplary embodiment, there is clearance between the inner surface 56 of the sleeve 50 and the outer surface of the engaging end 41 of the spray head 40 to allow the engaging end 41 to be inserted into the sleeve 50. The second material comprising the second portion 52 being configured to be flexible or compliant allows for there to be an interference fit configured between the inner longitudinal members 63 (i.e., those extending toward the center of the sleeve from the inner diameter) of the second portion 52 and the engaging end 41 of the spray head 40, which provides for stability of the sleeve 50 and spray head 40 when coupled. Upon insertion of the engaging end 41 of the spray head 40 into the sleeve 50, the surface of the engaging end 41 compresses the inner longitudinal members 63 of the second portion 52 of the sleeve 50 creating forces between the sleeve 50 and the spout 30 which function to both stabilize and retain the coupled spray head 40 and sleeve 50.

According to an exemplary embodiment, the engaging end 41 of the spray head 40 includes a detent 45 that is configured to be retained by the first retaining feature 57 of the sleeve 50 to thereby couple the sleeve 50 to the spray head 40. The detent 45 is configured to have an interference fit with the inner surface 56 of the sleeve 50, however, the detent 45 may be flexible or compliant, such that upon insertion of the of the engaging end 41 of the spray head 40 into the sleeve 50, the detent 45 is displaced away from the sleeve 50 by the inner surface 56 of the sleeve 50 to allow the engaging end 41 and detent 45 to pass through the inner surface 56 of the sleeve 50. The displacement of the detent 45 may create a force or stored energy, such as from the elastic deflection of the detent 45 or from a biasing member (e.g., a spring). When the spray head 40 has been inserted into the sleeve a predetermined distance, such that the detent 45 has moved adjacent to the first retaining feature 57 of the sleeve 50, the stored energy or force induces the detent 45 to move into engagement with the first retaining feature 57 of the sleeve 50 to thereby couple the spray head 40 to the sleeve 50.

The faucets disclosed herein include a coupling, described above as a sleeve, having a reduced number of components, which reduces the cost, such as the assembly cost, while reducing the variation in tolerances to provide improved performance with increased durability. For example, coupling may improve reliability by integrating the function of the O-ring and the bushing into a single sleeve. Additionally, the couplings disclosed herein may be configured with two materials co-molded together. For example, the first material may be generally rigid to provide structure and the second material may be more flexible. The interaction between the flexible material co-molded onto the rigid insert and the spray assembly allows for a smooth nesting and retraction of the spray, while providing for a positive grip preventing drooping or wobble. Also, the materials may be configured to more durable to prohibit the improved coupling from degrading over time.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the faucets as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A pull-out faucet, comprising:

a spout having an outlet end;

a spray head having an engaging end; and a sleeve disposed between the outlet end of the spout and the engaging end of the spray head and configured to detachably couple the spray head to the spout;

wherein the sleeve comprises a substantially rigid first portion including a first material and a substantially compliant second portion including a second material that is different than the first material;

wherein the second portion comprises a circumferential member extending around at least a portion of a circumference of the sleeve; and wherein the spout comprises a recess extending around at least a portion of the circumference of the spout and configured to receive the circumferential member.

2. The faucet of claim 1, wherein the first portion comprises an insert and the second portion comprises the second material molded onto the insert.

3. The faucet of claim 1, wherein the first portion defines at least one cavity that is filled by the second portion.

4. The faucet of claim 1, wherein the spout comprises an inner surface, and the spray head comprises an outer surface, and wherein when the spray head is coupled to the spout, the sleeve is disposed between the inner surface of the spout and the outer surface of the spray head.

5. The faucet of claim 1, wherein the second portion comprises a first longitudinal member intersecting the circumferential member and providing an interference fit between the sleeve and the spout.

6. The faucet of claim 5, wherein the second portion comprises a second longitudinal member providing an interference fit between the sleeve and the spray head and providing stability therebetween.

7. A pull-out faucet, comprising:

a sleeve having a rigid first portion and a compliant second portion, the second portion comprising a circumferential member extending around at least a portion of a circumference of the sleeve;

a spout coupled to the sleeve, the spout having a recess formed in a surface thereof, the recess configured to receive the circumferential member of the sleeve; and a spray head having an engaging end configured to releasably couple to the sleeve.

8. The faucet of claim 7, wherein the sleeve comprises a lip; and wherein the spout comprises an outlet end and a ledge formed in a surface of the spout, the ledge configured to receive the lip of the sleeve and to limit the distance the sleeve may be inserted into the spout.

9. The faucet of claim 7, wherein the engaging end of the spray head comprises a detent configured to releasably engage a retaining feature of the sleeve.

10. The faucet of claim 9, wherein sleeve comprises an inner surface and an outer surface, and the retaining feature comprises an inclined surface extending between the inner and outer surface.

11. The faucet of claim 7, wherein the spout comprises an inner surface, and the spray head comprises an outer surface, and wherein when the spray head is coupled to the spout, the sleeve is disposed between the inner surface of the spout and the outer surface of the spray head.

12. The faucet of claim 7, wherein the second portion comprises a first longitudinal member compressed between the sleeve and the spout thereby aligning the sleeve within the spout.

13. The faucet of claim 7, wherein the second portion comprises a second longitudinal member compressed between the sleeve and the spray head and providing stability therebetween.

14. A coupling sleeve for a pull-out faucet, the faucet including a spray head having an engaging end, the faucet further including a spout having an outlet end configured to receive the coupling sleeve and having an inner surface defining a recess, the coupling sleeve comprising:

an inner surface;

an outer surface;

a substantially rigid first portion; and a compliant second portion integrally formed on the first portion, the second portion comprising:

a circumferential member extending along the outer surface and configured to engage the recess of the spout; and a plurality of longitudinal members extending along the inner surface and configured to stabilize the spray head within the coupling sleeve.

15. The faucet of claim 14, wherein the second portion comprises a plurality of longitudinal members extending along the outer surface of the coupling sleeve and configured to stabilize the coupling sleeve within the spout.

16. The faucet of claim 14, wherein the first portion defines at least one cavity that is filled by the second portion.

17. The faucet of claim 14, wherein the first portion comprises an insert made from a first material and the second portion comprises a second material, which is different than the first material, molded onto the insert, such that the second portion is fixed to the first portion.

18. The faucet of claim 17, wherein the second portion comprises a base aligned with the circumferential member and configured to reduce flashing when the second portion is molded onto the first portion.

* * * * *